United States Patent [19]

Armstrong et al.

[11] 4,192,152

[45] Mar. 11, 1980

[54] SCROLL-TYPE FLUID DISPLACEMENT APPARATUS WITH PERIPHERAL DRIVE

[75] Inventors: Allen E. Armstrong, Lexington; John E. McCullough, Carlisle, both of Mass.

[73] Assignee: Arthur D. Little, Inc., Cambridge, Mass.

[21] Appl. No.: 896,161

[22] Filed: Apr. 14, 1978

[51] Int. Cl.[2] ..... F01C 1/02; F01C 11/00; F01C 21/00; F25D 17/00

[52] U.S. Cl. ..... 62/402; 418/5; 418/55; 418/151

[58] Field of Search ..... 418/5, 55, 57, 151; 62/402

[56] References Cited

U.S. PATENT DOCUMENTS

| | | | |
|---|---|---|---|
| 385,832 | 7/1888 | Allyn | 418/57 |
| 801,182 | 10/1905 | Creux | 418/55 |
| 1,376,291 | 4/1921 | Rolkerr | 418/55 |
| 2,475,247 | 7/1949 | Mikulasek | 418/55 |
| 2,494,100 | 1/1950 | Mikulasek | 418/55 |
| 2,841,089 | 7/1958 | Jones | 418/55 |
| 3,011,694 | 12/1961 | Audemar | 418/55 |
| 3,560,119 | 2/1971 | Busch et al. | 418/55 |
| 3,600,114 | 8/1971 | Dvorak et al. | 418/55 |
| 3,802,809 | 4/1974 | Vulliez | 418/55 |
| 3,817,664 | 12/1972 | Bennett et al. | 418/55 |
| 3,884,599 | 5/1975 | Young et al. | 418/55 |
| 3,913,351 | 10/1975 | Edwards | 62/402 |

FOREIGN PATENT DOCUMENTS

| | | | |
|---|---|---|---|
| 813559 | 3/1937 | France | 418/55 |

*Primary Examiner*—John J. Vrablik
*Attorney, Agent, or Firm*—Bessie A. Lepper

[57] ABSTRACT

Peripherally-driven scroll apparatus. The orbiting scroll member is attached through radially-compliant linking means to eccentrics mounted on three equally spaced crankshafts to accommodate differential thermal expansion without the generation of any appreciable elastic forces to increase bearing loads. Means are provided to prevent axial deflections in the stationary scroll members while permitting their supports to be designed and constructed for strength rather than stiffness. The apparatus may be staged and employed as a compressor or expander.

34 Claims, 13 Drawing Figures

SCROLL-TYPE FLUID DISPLACEMENT APPARATUS WITH PERIPHERAL DRIVE

This invention relates to scroll-type positive fluid displacement apparatus and more particularly to scroll-type apparatus having a peripheral drive mechanism.

There is known in the art a class of devices generally referred to as "scroll" pumps, compressors and engines wherein two interfitting spiroidal or involute spiral elements of like pitch are mounted on separate end plates forming what may be termed stationary and orbiting scroll members. These spiral elements are angularly and radially offset to contact one another along at least one pair of line contacts such as between spiral curved surfaces. A pair of line contacts will lie approximately upon one radius drawn outwardly from the central region of the scrolls. The fluid volume so formed therefore extends all the way around the central region of the scrolls. In certain special cases the pocket or fluid volume will not extend the full 360° but because of special porting arrangements will subtend a smaller angle about the central region of the scrolls. The pockets define fluid volumes, the angular position of which varies with relative orbiting of the spiral centers; and all pockets maintain the same relative angular position. As the contact lines shift along the scroll surfaces, the pockets thus formed experience a change in volume. The resulting zones of lowest and highest pressures are connected to fluid ports.

An early patent to Creux (U.S. Pat. No. 801,182) describes this general type of device. Among subsequent patents which have disclosed scroll compressors and pumps are U.S. Pat. Nos. 1,376,291, 2,475,247, 3,494,100, 2,841,089, 3,011,694, 3,560,119, 3,600,114, 3,802,809, and 3,817,664, British Pat. No. 486,192, and French Pat. No. 813,559.

As will be recognized from a review of this prior art, the mechanism used to drive the orbiting scroll member may be coaxially affixed to or integral with the orbiting scroll member or it may be arranged to engage the periphery of the orbiting scroll member, i.e., it may be a central or peripheral drive.

Although the concept of a scroll-type apparatus has been known for some time and has been recognized as having some distinct advantages, the scroll-type apparatus of the prior art, as represented, for example, in the above-cited patents, has not been commercially successful, primarily because of sealing and wearing problems which have placed severe limitations on the efficiencies, operating life, and pressure ratios attainable. These sealing and wearing problems are present in all scroll machinery whether they use central or peripheral drive means; and they are of both radial and tangential types. Thus, effective axial contacting must be realized between the ends of the involute spiral elements and the end plate surfaces of the scroll members which they contact to seal against radial leakage and achieve effective radial sealing; and for highly efficient machines effective radial contacting with minimum wear must be attained along the moving line contacts made between the involute spiral elements to seal against tangential leakage.

Recently, however, the problems associated with sealing and wear-in centrally driven scroll apparatus have been minimized to the extent that scroll machinery of this general type is able to compete in efficiency with other types of compressors and expansion engines. Solutions to these problems are embodied in the novel apparatus described in U.S. Pat. Nos. 3,874,827, 3,884,599, 3,924,977, 3,994,633 and 3,994,636, all of which are assigned to the same assignee as this present application. These solutions include providing means to counteract at least a portion of the centrifugal forces acting on the orbiting scroll member and to control tangential sealing forces along line contacts between the involute wraps of the scroll members; providing axial compliance/sealing means to insure efficient radial sealing between the involute wrap ends and the surfaces of the scroll member end plates; and providing novel means for developing axial forces to continually urge the scroll members into contact to maintain radial sealing.

As a result of the provision of these solutions to the construction problems associated with centrally driven scroll apparatus, there has now developed a demand for a number of different scroll-type apparatus of a wide range of capabilities to meet a growing demand for compressors and expanders in a number of different applications. Among the demands most recently recognized are those for compressors and expanders for large (e.g., greater than 50 HP) power applications, those where high efficiency is a paramount requirement, and those where high efficiency coupled with relatively low operating pressure is a required characteristic of the machinery. In scroll-type machinery in which these demands must be met, it is highly desirable to use peripheral drive means since it is more efficient to handle power through such means than through a single center shaft and since it makes it possible to take advantage of essentially all of the volume of the central pocket which is always at the highest pressure.

The use of a peripheral drive, however, creates sealing problems, particularly radial sealing problems, which are not encountered in the use of centrally driven scroll apparatus and which are not totally solved by the application of one or more of the solutions applied to the sealing and wearing problem associated with centrally driven scroll machinery. A number of prior art patents teach one or another form of peripheral drive. Representative of such prior art patents are U.S. Pat. Nos. 1,376,291, 3,475,247, 2,841,089, 3,011,694, 3,600,114 and 3,802,809. Of these, U.S. Pat. No. 3,011,694 may be viewed as exemplary of the prior art of peripherally-driven scroll apparatus and representative of the failure of the prior art to recognize and solve those sealing problems which are inherent in the use of peripheral drive means.

In the apparatus of U.S. Pat. No. 3,011,694 there is no provision made to accommodate thermal expansion differences between the scroll members and the frame of the housing. The peripheral driving means comprises six equally-spaced shafts, each having two eccentrics (for two separate orbiting scroll members) and terminating in a pinion driven by a central gear. Since these eccentric shafts have close-fitting bearings on both the frame and the orbiting scroll members, any differential expansion across the orbiting scroll members will develop high bearing loads as elastic-deformations accommodate incompatible displacements. The temperature differences across the scroll members can arise from the introduction of hot or cold inlet gases into the scroll apparatus and from the effects of compression or expansion.

The stationary scroll member or members of the prior art peripherally-driven scroll apparatus are subject to an outward deflection, or bowing, which gives rise to internal radial leakage across the ends of the involute wraps. The prior art solution to this problem has been to stiffen the end plates of the stationary scroll members and of the housing frame, a solution which adds materially to the weight and cost of the apparatus without actually being an adequate answer to the problem.

The use of peripheral drive means, in permitting the orbiting of relatively large scroll members, provides a mechanism particularly suitable for the operation of scroll machinery in which the orbiting scroll member has involute wraps oppositely disposed on its two sides, the involute wrap of each side engaging the involute wrap of a separate stationary scroll member to form a two-stage machine. Alternatively, two or more separate orbiting scroll members may be driven by a-single peripheral drive means to provide a multistage device. The use of a scroll member (orbiting or stationary) with oppositely disposed involute wraps engaging wraps of separate complementary scroll members is known in the art as evidenced by U.S. Pat. Nos. 801,182, 2,841,089, 3,011,694, 3,560,119, 3,600,114, 3,802,809, and 3,817,664. Again, in discussing this prior art it will be convenient to take U.S. Pat. No. 3,011,694 as exemplary.

The prior art devices incorporating a peripheral drive mechanism along with one or more scroll members having involute wraps oppositely disposed on the two sides of the plate to form a multistaged device have exhibited leakage problems which are unique to such an arrangement. For example, as will be seen in U.S. Pat. No. 3,011,694, although some attempt is made to balance the axial pressure on each side of the orbiting scroll member by means of holes at the center and along the periphery of the plate, pressure imbalance in the opposed moving fluid pockets may occur by reason of different leakage rates across the ends of the involute wraps in the two scroll machines. To counteract this imbalance, the plate of the scroll member having opposite involute wraps is made very thick relative to the height of the involute wraps. This results in heavy scroll members and large bearing loads.

Finally, it would seem to be a simple matter to use a multistage scroll apparatus to construct a Brayton cycle machine, one side or stage being a compressor and the other an expander with heat input or heat rejection means connecting the two stages. Such an arrangement is suggested in Czechoslovakian application Nos. 5354-68 and 6370-68 on which U.S. Pat. No. 3,600,114 is based. However, major problems arise in the operation of such a device because of the differences in pressures and temperatures on the two sides of the orbiting scroll member which cause warping and axial deflection with resultant increases in frictional loads and internal leakage.

Therefore, although peripherally driven scroll-type apparatus have been recognized to possess certain economical and operational advantages, these advantages have not been realized because of the particular and unique sealing and wearing problems. Scroll-type apparatus do, however, have a number of potential advantages (e.g., high efficiency, a wide range of operating conditions, reduced vibration and absence of valves) provided such sealing and wearing problems can be minimized or eliminated.

It is therefore a primary object of this invention to provide improved scroll-type positive fluid displacement apparatus which are peripherally driven. It is another object to provide apparatus of the character described which are particularly suited for large power applications as compressors and/or expanders, which attain a relatively high overall efficiency, which may operate on relatively low working pressures or which may possess any combination of these characteristics. Still another object is to provide peripherally-driven scroll apparatus capable of accommodating thermal expansion differences between the scroll members and housing frame, which may be constructed for strength without adding bulk or weight and which incorporate means to minimize or eliminate axial deflections of the stationary scroll member.

It is another primary object of this invention to provide improved, peripherally-driven, multistage scroll-type apparatus in which one or more of the scroll members has oppositely disposed involute wraps on the two sides of a scroll member plate to define at least two stages with complementary engaging scroll members. A further object is to provide multistage scroll-type apparatus of the character described which may be constructed as multistaged compressors or as multistaged expanders. Still another object is to provide a peripherally-driven, scroll-type apparatus comprising at least one compression stage and at least one expansion stage which, in combination with heat exchange means, serves as a heat engine, heat pump, or refrigerator.

Other objects of the invention will in part be obvious and will in part be apparent hereinafter.

For a fuller understanding of the nature and objects of the invention, reference should be had to the following detailed description taken in connection with the accompanying drawings in which FIG. 1 is a longitudinal-cross section of a peripherally driven scroll expander constructed in accordance with this invention;

Figure 1:
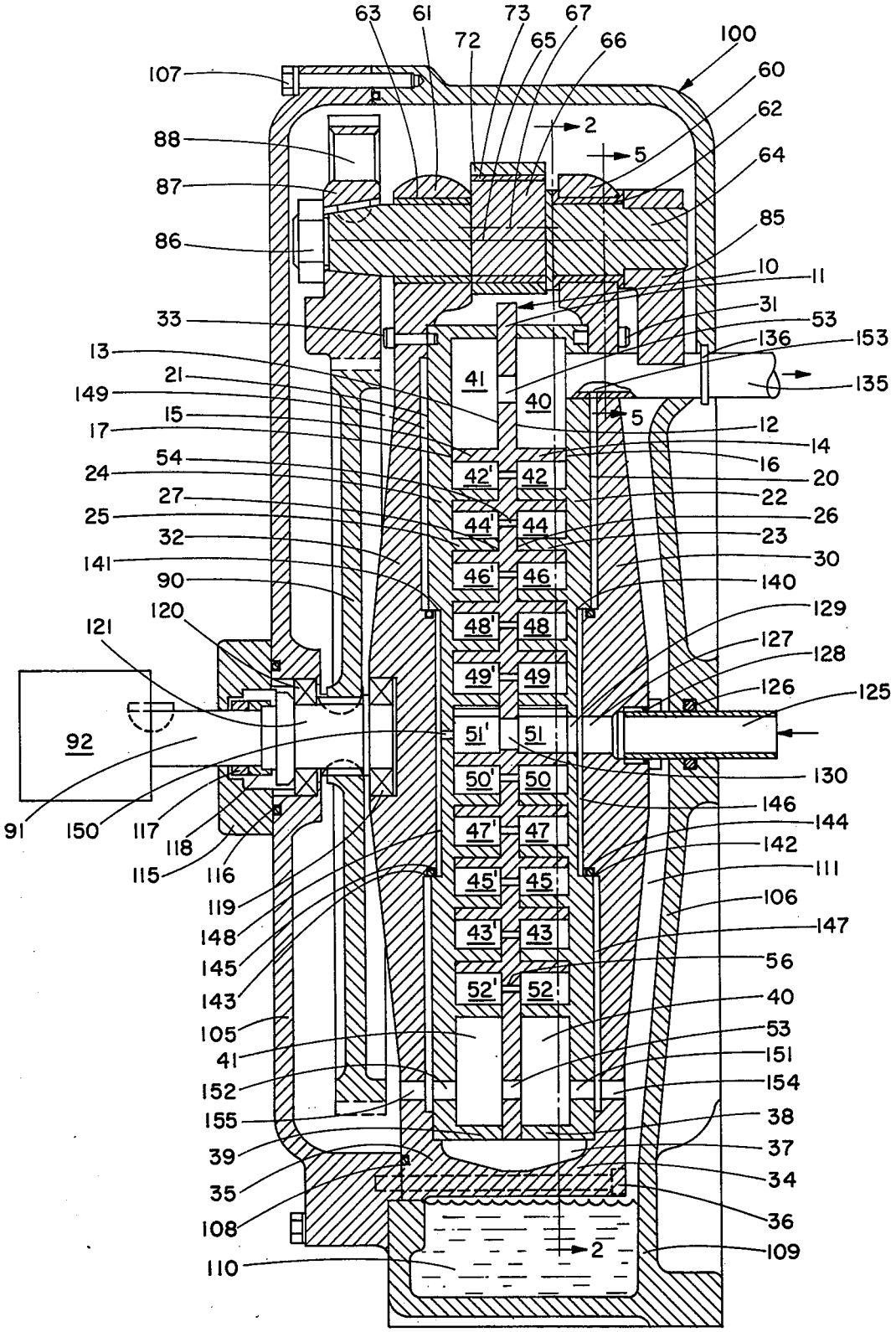

According to one aspect of this invention there is provided a positive fluid displacement apparatus, comprising in combination, an orbiting scroll member comprising a plate having mirror-imaged involute wraps affixed to opposite surfaces of the plate and three equally-spaced peripheral extensions; first and second oppositely disposed stationary scroll members, each comprising an end plate having an involute wrap affixed thereto engageable with an involute wrap of the orbiting scroll member, whereby when said orbiting scroll member is orbited with respect to the stationary scroll members the flanks of the engaging wraps along with the plate of the orbiting scroll member and the internal facing surface of the end plates of the stationary scroll members define mirror-imaged moving pockets of variable volume and zones of high and low fluid pressures; first and second oppositely disposed stationary scroll support members affixed to the first and second stationary scroll members respectively, only around their peripheries, each of the support members having three equally-spaced peripheral projections axially aligned with the peripheral projections of the opposed scroll support member; three equally spaced crankshafts, each having affixed thereto a satellite gear and each being supported in the axially-aligned projections of the opposed scroll support members and rotatable with respect to the stationary scroll members; an orbiting scroll eccentric affixed to each of the crankshafts and interposed between the peripheral projections; radially compliant linking means mechanically connecting the orbiting scroll member through the peripheral extensions to said eccentrics whereby there is provided a three-link connection around the orbiting scroll member; fluid passage means in fluid communication with the zones of high and low fluid pressures; a central gear engageable with the satellite gears and mounted on a rotatable shaft; and energy converting means connected to the rotatable shaft arranged to either drive the shaft or absorb energy from its rotation.

According to another aspect of this invention there is provided a multistage positive fluid displacement apparatus, comprising in combination at least two scroll means, each of which serves as a stage and comprises in combination an orbiting scroll member comprising a plate having mirror-imaged involute wraps affixed to opposite surfaces of the plate and three equally-spaced peripheral extensions; first and second oppositely disposed stationary scroll members, each comprising an end plate having an involute wrap affixed thereto engageable with an involute wrap of the orbiting scroll member, whereby when the orbiting scroll member is orbited with respect to the stationary scroll members the flanks of the engaging wraps along with the plate of the orbiting scroll member and the internal facing surfaces of the end plates of the stationary scroll members define mirror-imaged moving pockets of variable volume and zones of high and low fluid pressures; first and second oppositely disposed stationary scroll support members affixed to the first and second stationary scroll member respectively, only around their peripheries, each of the support members having three, equally-spaced peripheral projections axially aligned with the peripheral projections of the opposed scroll support member; three equally spaced crankshafts, each having affixed thereto a satellite gear and each being supported in the axially aligned projections of the opposed scroll support members and rotatable with respect to the stationary scroll members of the scroll means; orbiting eccentrics, one for each of the orbiting scroll members, affixed to each of the crankshafts; radially compliant linking means mechanically connecting the orbiting scroll members through the peripheral extensions to the eccentrics whereby there is provided a three-link connection around each of the orbiting scroll members; a central gear engageable with the satellite gears and mounted on a rotatable shaft; housing means defining therein a volume in which the scroll means, the crankshafts and said gears are located; fluid passage means in fluid communication with the zones of high and low fluid pressures of the scroll means; and energy converting means connected to the rotatable shaft arranged to either drive the shaft or absorb energy from its rotation.

The invention accordingly comprises the features of construction, combination of elements, and arrangements of parts which will be exemplified in the constructions hereinafter set forth, and the scope of the invention will be indicated in the claims.

One embodiment of the apparatus of this invention is illustrated as an expander in FIGS. 1–8. In the following description of this embodiment reference should be had to all of the drawings in FIGS. 1–8 in which like reference numerals are used to identify the same components.

The expander illustrated has an orbiting scroll member, generally indicated by the reference numeral 10, formed of an orbiting plate 11 which has affixed to or integral with its opposing surfaces 12 and 13 oppositely disposed, mirror-imaged involute wraps 14 and 15, respectively, the wraps having axially-sealing end surfaces 16 and 17. Two stationary scroll members 20 and 21 are provided, these scroll members being formed, respectively, of end plate 22 with involute wrap 23 and end plate 24 with involute wrap 25, these wraps having axially-sealing end surfaces 26 and 27. End plate 22 of stationary scroll member 20 is fixedly mounted around its periphery to a scroll support member 30 by means of a number of screws such as 31. In like manner, stationary scroll member 21 is fixedly mounted around its periphery to an oppositely disposed scroll support member 32 by screws 33, these scroll support members 30 and 32 being configured around their peripheries to define annular extensions 34 and 35 through which they are bolted together and affixed to the main scroll housing by bolts such as 36, to define between them a volume 37 in which the scroll members are located.

Figure 2:
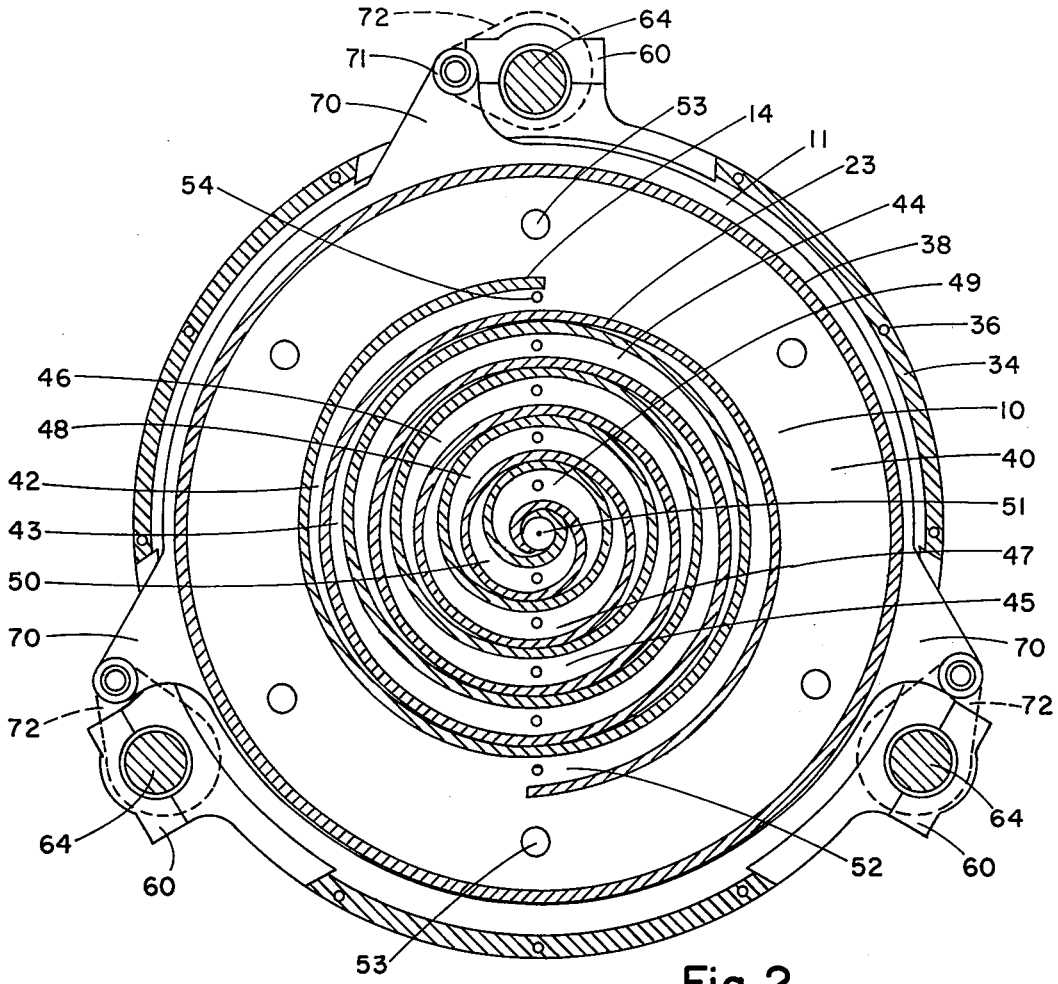
FIG. 2 is a cross section of the expander of FIG. 1 taken through plane 2—2 of FIG. 1 and showing one set of scroll members.
Figure 3:
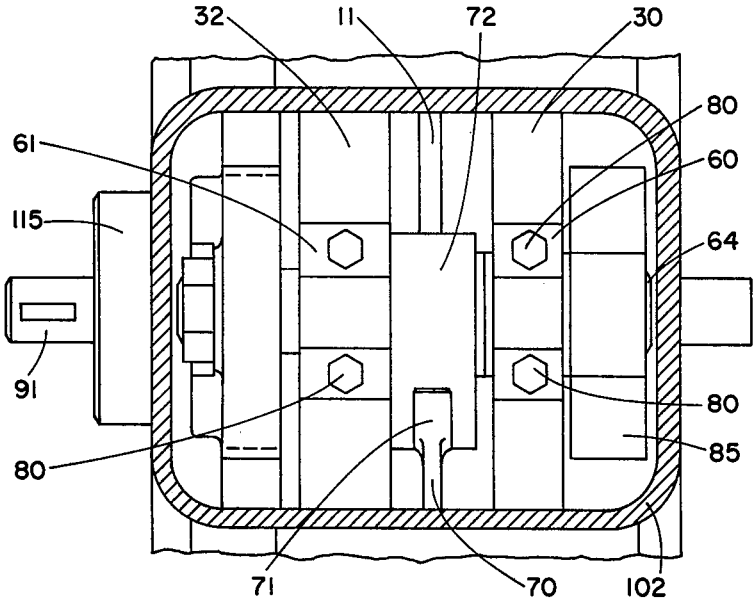
FIG. 3 is a top plan view, taken along plane 3—3 of FIG. 4, of the driving means for the orbiting scroll member.

The end plates 22 and 24 of the two stationary scroll members terminate around their peripheries in annular rings 38 and 39 of the same heights as involute wraps 23 and 25, which make contact, either directly or through a compliant sealing means, with surfaces 12 and 13 of the orbiting scroll plate 11. There is thus defined two opposing fluid volumes 40 and 41 on either side of orbiting scroll plate 11. In another embodiment of this apparatus, annular rings 38 and 39 are omitted, in which case fluid volumes 40 and 41 are open to the housing volume and the low-pressure zone of the scroll apparatus is equal to the housing pressure. The fluid volumes 40 and 41 contain the moving fluid pockets, for example pockets 42–52 shown in FIG. 2 for volume 40. Corresponding fluid pockets 42'–52' are defined in volume 41 as will be seen in FIG. 1. The fluid pressure in these pockets is highest in central pockets 51 and 51' and it decreases radially outward. In order to balance the pressures in the corresponding pockets on either side of orbiting plate 11, and hence throughout the two scrolls, a number of fluid ports are drilled in plate 11. These ports are illustrated by passages 53 located around the outer portion of plate 11 and small passages 54 so located that there is also fluid communication between the corresponding pockets 42 and 42', 43 and 43' etc., on either side of plate 11. The location of passages 53 and 54 in FIGS. 1 and 2 is somewhat diagrammatic, and it will be appreciated that they may be positioned anywhere so long as the above-stated requirement is met.

Figure 7:
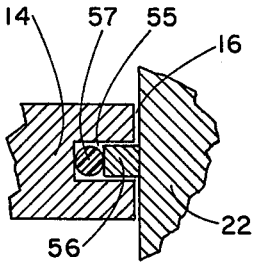
FIG. 7 illustrates in cross section a preferred compliant radial seal between the end surfaces of the involute wraps and the contacting scroll plate.

In order to achieve efficient axial sealing between the end surfaces of the wraps and the plates of the opposing scroll members, it is preferable to provide means to maintain effective sealing contact over long periods of operation. Illustrative of such means are the axially compliant sealing means of FIG. 7 and the abradable seal members of FIG. 8. The compliance/sealing means of FIG. 7 illustrates its use in conjunction with the end surface 16 of involute wrap 14 of the orbiting scroll member and end plate 22 of stationary scroll member 20; and it is essentially identical to that disclosed in U.S. Pat. No. 3,994,636. In the use of this compliance/sealing means, the surface 16 of the involute wrap has a channel 55 cut along essentially its entire length and within this channel are located a seal element 56 configured to correspond to the involute configuration of wrap 14 and sized to be able to experience small axial and radial excursions within channel 55; and force applying means, e.g., elastomeric member 57, to actuate the seal element and force it in axial sealing contact with the internal surface of 22.

Figure 8:
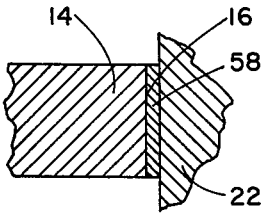
FIG. 8 illustrates the use of an abradable end seal in place of the compliant seal of FIG. 7.

In the modification of FIG. 8, the surface 16 of involute wrap 14 is shown to be coated along its entire length with an abradable material, such as molybdenum sulfide paint, which will wear with running to form the necessary sealing contact. Axial sealing means are, of course, also provided on the contacting end surface 17 of orbiting wrap 15, and on the contacting end surfaces 26 and 27 of the stationary scroll wraps 23 and 25, respectively.

Scroll support members 30 and 32 each have three, equally spaced, peripheral projections 60 and 61, respectively, providing three equally spaced support means, through journal bearings 62 and 63, for three orbiting scroll member crankshafts 64 having axes of rotation 65. Mounted on each crankshaft 64 are eccentrics 66 having axes of rotation 67, the distance between axes 65 and 67 being equal to the orbit radius of orbiting scroll member 10.

As will be seen from FIGS. 2–4 and 6, the orbiting scroll member plate 11 has three equally spaced peripheral extensions 70, each terminating in a pin shaft mounting section 71 through which the peripheral extensions, and hence the orbiting plate 10, is pivotally attached to a movable linking member 72 which in turn is pivotally mounted on its corresponding eccentric 66 through a journal bearing 73. As will be seen in FIG. 6, the attachment of each peripheral extension to linking member 72 is through pin shaft 78 and journal bearings 79. Through this mechanism the orbiting of scroll member 10, effected by the expanding fluid traveling from central pockets 51 and 51' to peripheral volumes 40 and 41, imparts rotational motion to crankshaft 64.

These linking attachments between crankshafts 64 and the orbiting scroll member provide means to accommodate thermal expansion differences between the scroll members and the frame, for the linking members 72 which comprise the means of attachment between the orbiting scroll member and the crankshafts are provided with sufficient radial compliance to accommodate differential thermal expansion. The result of this arrangement is the provision of radially compliant linking means.

As will be apparent from the drawings, each linking member contains the outer race of the bearing on the eccentric shaft 66 and the result of this pivotal three-link connection around the orbiting scroll member is a kinematic mounting which uniquely locates the orbiting scroll member in relation to the machine frame. This is accomplished without redundancy. In this manner any radial expansion of the orbiting scroll member is accommodated by the motion of linking members 72; and if the orbiting scroll member expands equally in all three directions, the location of the scroll center will remain unchanged, no appreciable elastic forces will be generated, and the bearing loads will remain low.

Figure 5:
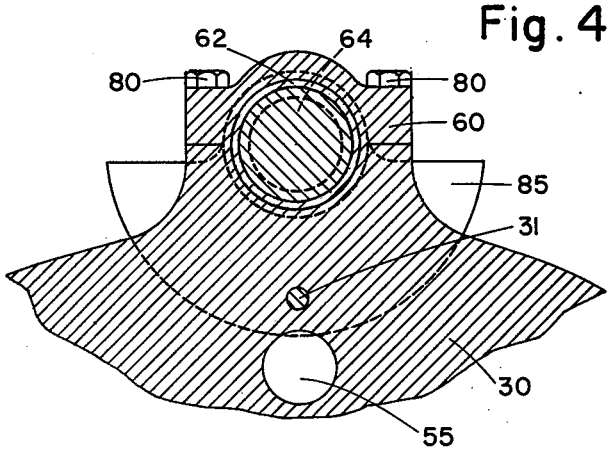
FIG. 5 is a partial cross section of a stationary scroll support member showing a crankshaft counterweight taken along plane 5—5 of FIG. 1.

One of the three peripheral projections 60 of stationary scroll member 30 is shown in FIG. 5. As will be seen in FIG. 5, these projections are of a two-piece construction bolted together by bolts 80 (see also FIG. 3). The remaining projections on stationary scroll members 30 and 32 are similarly constructed to provide support and alignment for crankshaft 64. A counterweight 85 is mounted on one end of shaft 64 and these counterweights, along with their associated counterweighted driving gears 87, effectively eliminate all unbalanced forces in the machine.

Crankshaft 64 terminates at its other end in a tapered configuration (FIG. 1) adapted to have keyed thereto and rigidly mounted thereon, through screw 86, a counterweighted satellite gear 87 serving in the expander as a driving gear. Counterweighting of gear 87 is accomplished by drilling several holes 88 therethrough to adjust the metal weight. The three driving gears 87 (one associated with each shaft 64) engage a central driven gear 90 rigidly affixed to main machine shaft 91. Through this arrangement the work developed by the expansion of the high-pressure fluid delivered to the expander is converted to the rotary motion of crankshaft 64 and then to rotary motion of main shaft 91. This work is delivered to a suitable energy converting means 92, which in the case of an expander will be a suitable work absorbing means such as a motor, brake or the like.

It will be appreciated that if the apparatus of FIG. 1 is to be used as a compressor, the roles of central gear 90 and satellite gears 87 will be reversed. In such an operational mode energy converting means 92 will be a motor provided to rotate shaft 91; and central gear 90 will become the driving gear to rotate satellite gears 87 and hence the three crankshafts 64 and eccentrics 66. The positive orbiting of scroll member 10 will then result to cause low-pressure fluid to move inwardly and increase in pressure.

Figure 4:
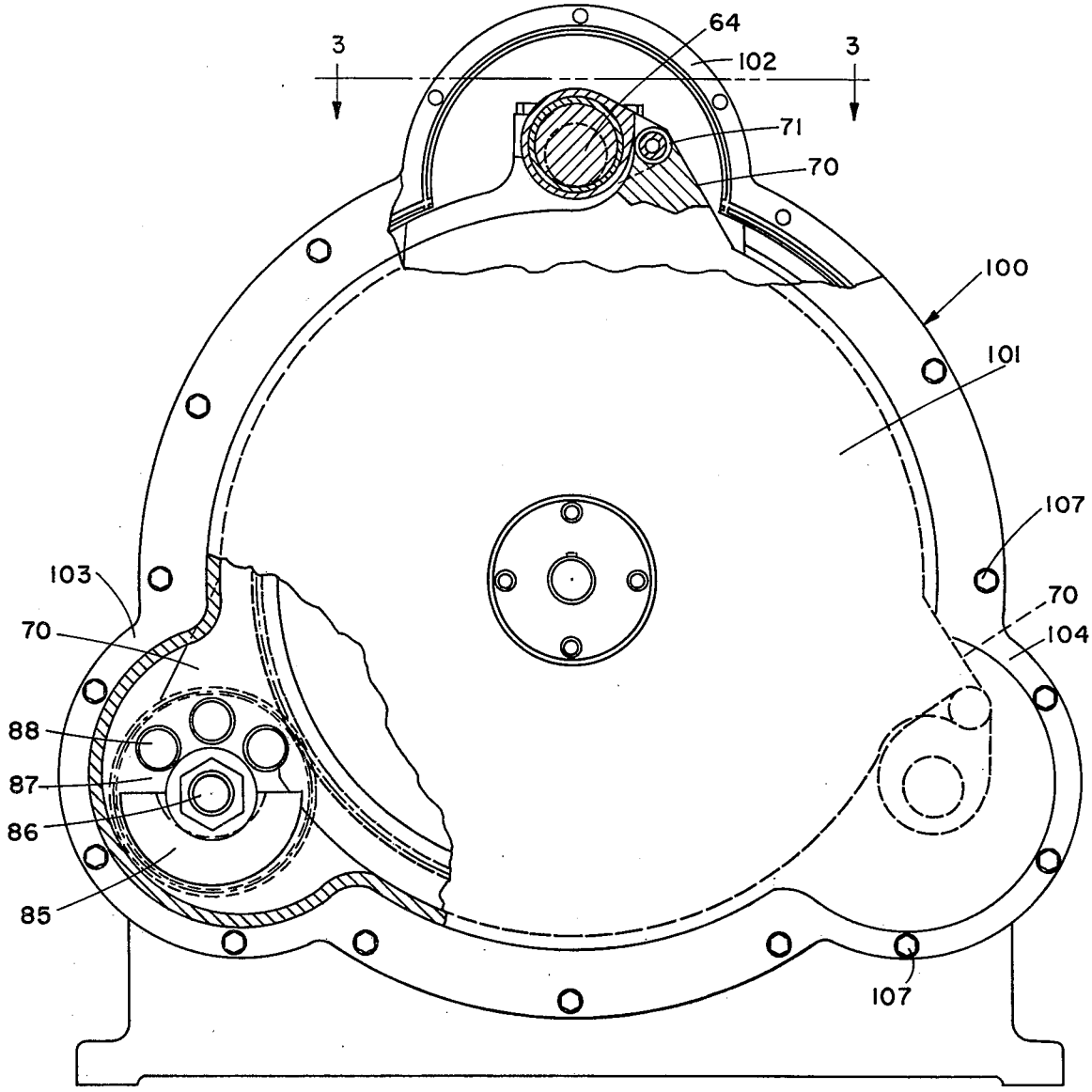
FIG. 4 is an end view with partial cross sectional views, of the expander of FIG. 1.

The scroll members 10, 20 and 21, stationary scroll supports 30 and 32, orbiting shaft systems, and gears 87 and 90 are all located within a housing 100 which comprises, as shown in FIG. 4, a central, essentially cylindrical section 101 and three, equally spaced, semicircular sections 102, 103 and 104 housing the shaft systems and gears 87. For convenience, housing 100 is constructed in two parts 105 and 106 (FIG. 1) which are bolted together with a plurality of bolts 107 and sealed with an elastomeric sealing ring 108, to define within the housing a fluid-tight volume 111. This general configuration of housing 100 is modified along its bottom portion 109 to define therein an oil sump 110 which is in fluid communication with internal volume 111 of the housing. The oil from sump 110 is pumped under pressure by a conventional oil pump (not shown) to the bearing in the same manner as in an internal combustion engine.

Associated with main shaft 91 is a sealing system which makes it possible to maintain a pressure differential across the housing wall. This sealing system comprises a seal holder 115, an elastomeric sealing ring 116 and a magnetic seal formed of a sealing member 117 affixed to seal holder 115 and moving seal member 118 rotating with shaft 91. Shaft 91 is supported and aligned by bearing 119 and bearing 120 held by bearing nut 121. High-pressure fluid line 125 (e.g., inlet line of an expander) enters housing volume 111 through elastomeric sealing ring 126 and extends into central passage 127 in stationary scroll member support 30 through sealing ring 128. Plate 22 of stationary scroll member 20 has a central fluid passage 129 aligned with passage 127 and communicating directly with central, high-pressure fluid pocket 51 and indirectly with fluid pocket 51' through central passage 130 in orbiting scroll member plate 11. In a similar manner, the low-pressure fluid line 135 (e.g., discharge line of an expander) is sealed to housing section 106 through sealing ring 136 and passes through scroll support member 30 to communicate with scroll volumes 40 and 41. It will, of course, be understood that if the apparatus of FIG. 1 is used as a compressor, inlet line 125 will be the discharge line and discharge line 135 will be the inlet line.

Outward deflection of the end plates 22 and 24 of stationary scroll members 20 and 21 is minimized or essentially eliminated through the configuration of the end plates and their support members and through the use of pressurized fluid derived from the scroll volumes. Thus, as will be seen in FIG. 1, end plates 22 and 24 have cut on their external noncontacting surfaces centrally-located, cylindrically-configured shallow wells 140 and 141 serving as piston cylinders. Stationary scroll support members 30 and 32 have correspondingly sized, cylindrically-configured pistons 142 and 143 integral with their internal surfaces arranged to make sliding contact with the internal walls of cylinders 140 and 141 and to be slidably sealed thereto through sealing rings 144 and 145. There are thus defined between the central areas of the facing surfaces of end plate 22 of stationary scroll member 20 and of the scroll support member 30 a shallow fluid volume 146, and between the facing surfaces of the surrounding annular areas of these two components a shallow annular fluid volume 147. In like manner, there are defined a shallow central fluid volume 148 and annular fluid volume 149 between the facing surfaces of end plate 24 of stationary scroll member 21 and its associated stationary scroll support member 32. It will be seen that central volume 146 is in fluid communication with the zone of highest pressure, i.e., with inlet passage 126 and central pocket 51. Similarly, central volume 148 is in fluid communication, through port 150, with central pocket 51' which is also at the highest fluid pressure within the scrolls.

Annular fluid volumes 147 and 149 are in fluid communication with the peripheral, lowest pressure zones of the scrolls through one or more fluid ports 151 and 152 cut in end plates 22 and 24, respectively, and through port 153 in low pressure line 135. Finally, fluid communication is provided between peripheral scroll volumes 40 and 41 and the internal volume 111 of the housing through ports 154 and 155 in the stationary scroll support members 30 and 32.

The provision of the sealed central fluid volumes 146 and 148 essentially eliminates axial deflection of the fixed scroll members caused by the radial gradient of fluid pressure in the scrolls. By choosing the area of pistons 142 and 143 such that the sum of high pressure (e.g., inlet pressure in an expander) and low pressure (e.g., discharge pressure in an expander) integrated over the various pocket areas, the net pressure force across the fixed scroll members is effectively zero. This minimizes or essentially eliminates axial deflection of the stationary scroll members and requires only moderate thickness of the machine frame, i.e., the supporting members 30 and 32. This, in turn, means that the frame can be designed from strength considerations rather than stiffness and that both the amount of metal used and the cost of manufacturing the machine may be reduced.

Figure 9:
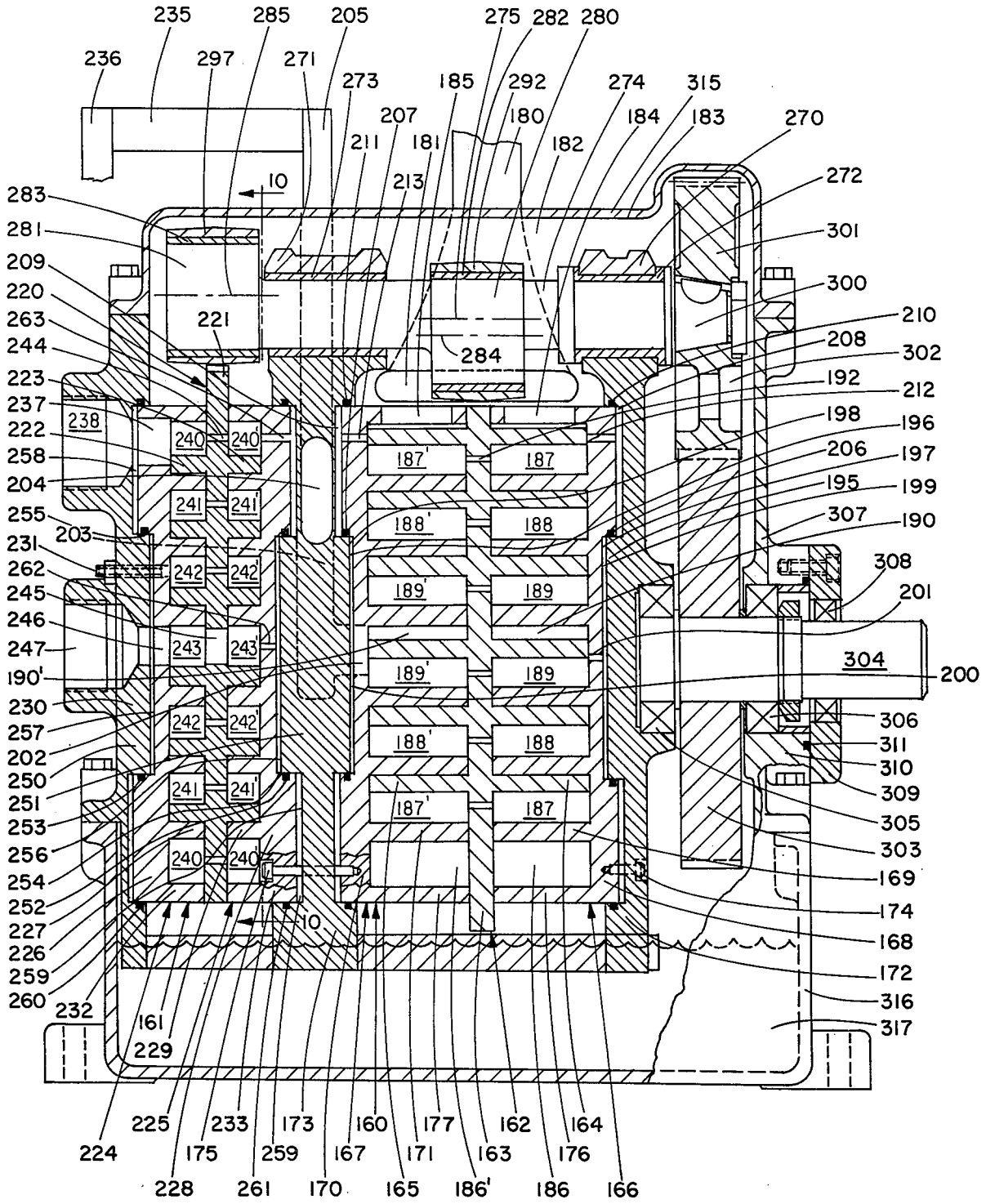
FIG. 9 is a longitudinal cross section of a two-stage compressor constructed in accordance with this invention.
Figure 10:
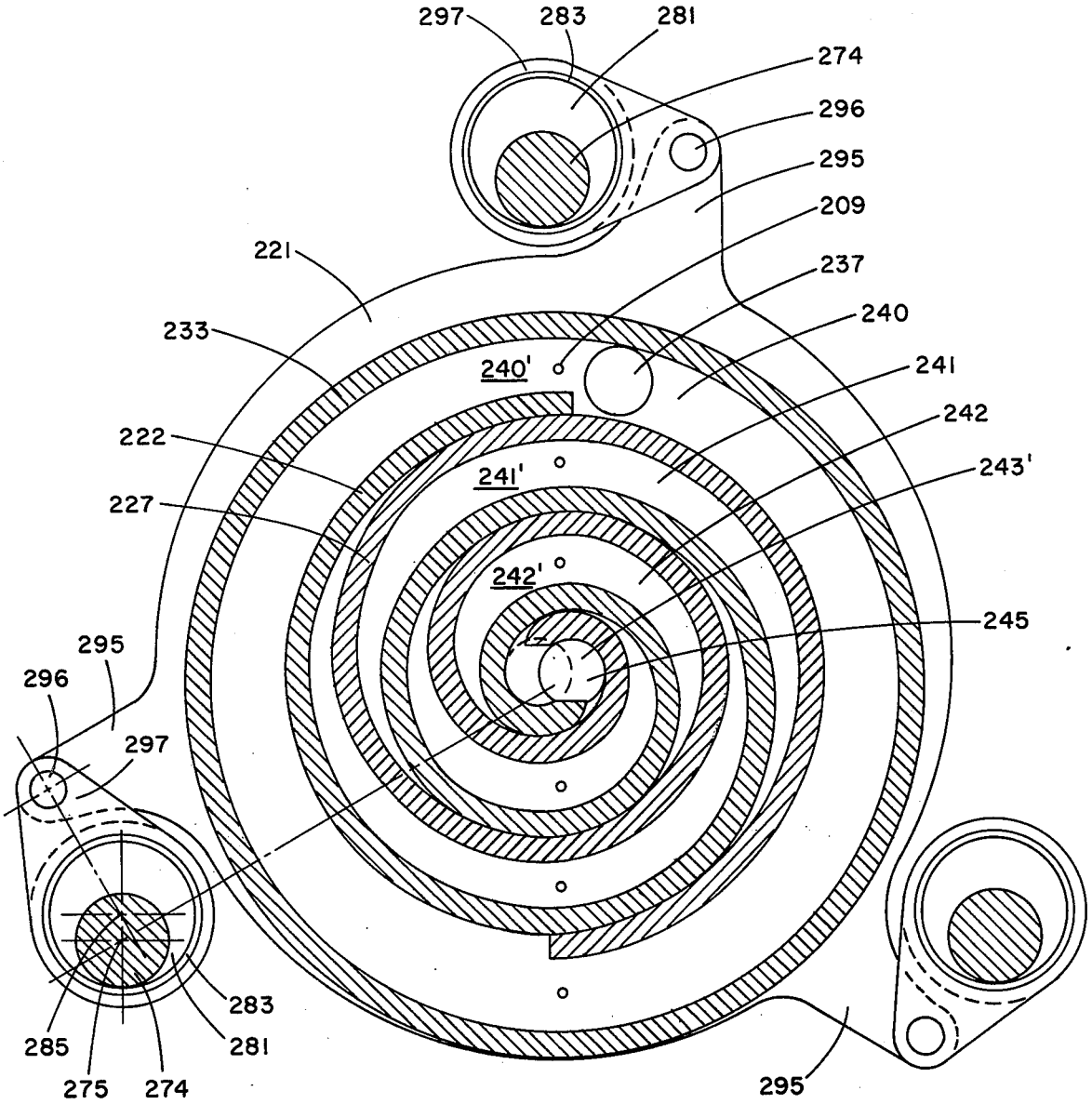
FIG. 10 is a transverse cross section taken through plane 10—10 of the compressor of FIG. 9.
Figure 11:
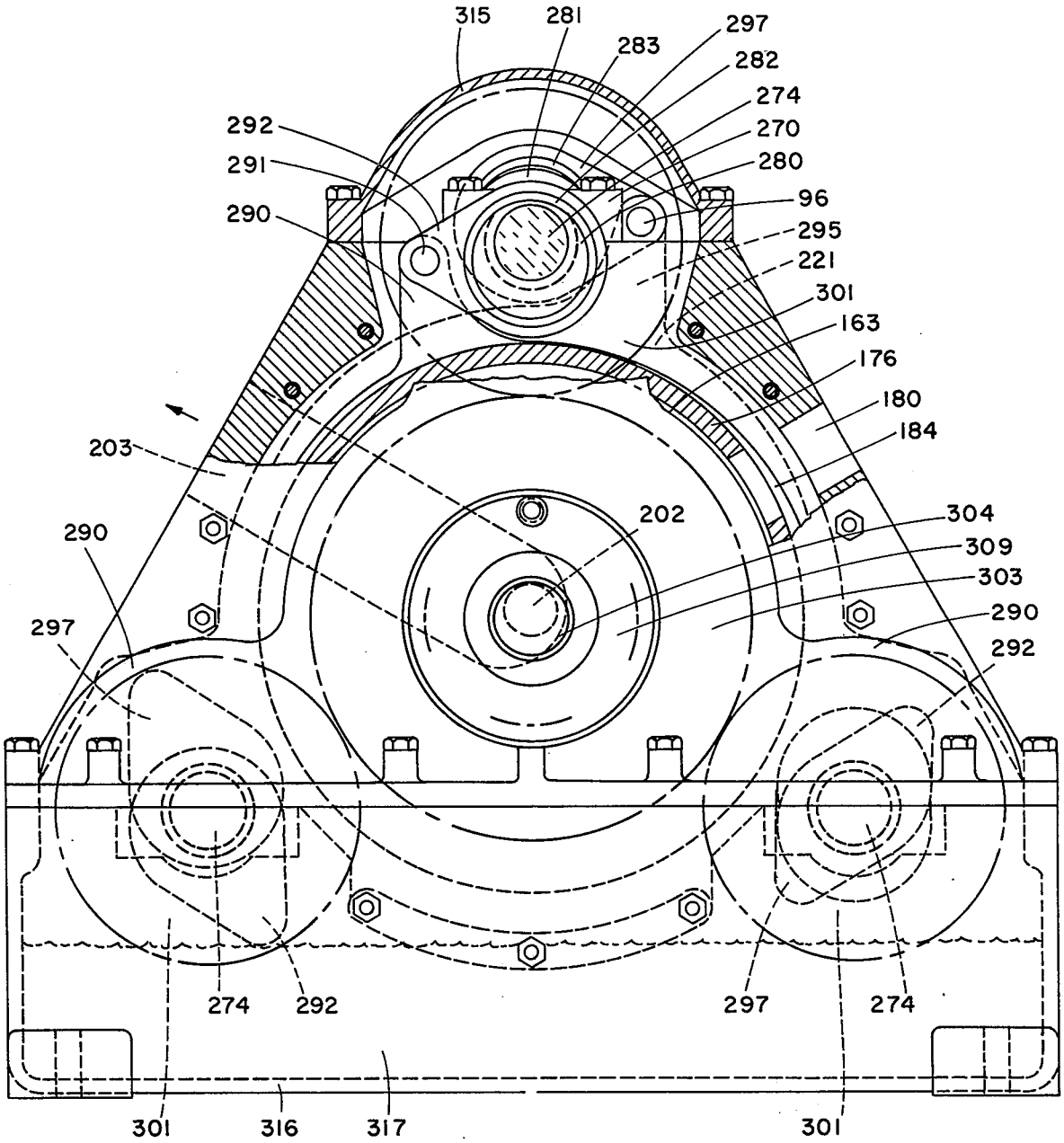
FIG. 11 is an end view, partially cut away to show cross sectional details, of the two-stage compressor of FIG. 9.

FIGS. 9–11 illustrate a two-stage compressor, constructed in accordance with this invention, having a first stage 160 and a second stage 161. The first stage compressor 160 has an orbiting scroll member 162 formed of plate 163 with mirror-imaged involute wraps 164 and 165 integral with or affixed to the opposing surface of plate 163. As in the case of the apparatus of FIG. 1, two stationary scroll members 166 and 167 formed, respectively, of end plate 168 and involute wrap 169 and of end plate 170 and involute wrap 171, are bolted to stationary scroll support member 172 and 173 through bolts 174 and 175. These stationary scroll members terminate peripherally in annular walls 176 and 177 which make contact with plate 163 of the orbiting scroll member. The axial sealing means shown in FIGS. 7 and 8 are, of course, applicable to the scroll members of both stages of the compressor of FIG. 9.

Fluid to be compressed by the first-stage compressor 160 is brought in through low-pressure inlet line 180 and, in the embodiment illustrated in FIG. 9, it is delivered by way of port 181 into the internal volume 187 defined within the fluid-tight housing 183. Thus, FIG. 9 may be thought of as illustrating a compressor in which the intake fluid is at ambient pressure. Fluid ports 184 and 185 are cut in peripheral rings 176 and 177 of the stationary scroll members to introduce the fluid to be compressed into the peripheral volumes 186 and 186' of the scrolls. The fluid pressure in pockets 187 through 190 (also pockets 187' through 190') increases radially inward; and small-diameter fluid ports 192 are drilled in plate 162 at appropriate locations to ensure the equalization of fluid pressure in the corresponding pockets 187 and 187', etc.

Stationary scroll support members 172 and 173 have central piston-configured surfaces 195 and 196 engaging the internal walls of cylinder-defining walls 197 and 198 in end plates 168 and 170 to provide high-pressure fluid volumes 199 and 200 which are in fluid communication with the zones of highest pressure in scroll 160. In the case of volume 199 this fluid communication is provided through port 201 while in the case of volume 200 it is provided by high-pressure fluid discharge port 202 which in turn leads through passage 203 to discharge line 204 connected to external fluid conduit 205. Sealing of volumes 199 and 200 is maintained through the use of suitable elastomeric sealing rings 206 and 207.

In the same manner as described for the apparatus of FIG. 1, peripheral annular fluid volumes 208 and 209, sealed by sealing rings 210 and 211, are defined between the stationary end plates 168 and 170 and their respective support means 172 and 173 and in fluid communication with the zones of lowest pressures 186 186' through ports 212 and 213.

The purpose of central, high-pressure fluid volumes 199 and 200 and of annular low-pressure volumes 208 and 209 is the same as that described for the corresponding volumes 146 and 148 and volumes 147 and 149 of the apparatus of FIG. 1. The areas of pistons 195 and 196 are chosen to meet the above-detailed requirements.

It is also, of course, within the scope of this invention to operate with the inlet pressure of the first stage other than atmospheric. In such cases, inlet line 180 may be modified to be sealed to inlet ports 184 and 185 if the residual housing volume 182 is not to be maintained at the inlet pressure.

The second-stage compressor 161 is constructed in the same manner as the first stage except that the actual volumes of the corresponding moving fluid pockets and zones of high and low pressure are inversely proportional to the average fluid pressures in the two stages, the volume decrease in the second stage being attained through a decrease in the height of the involute wraps. As will be seen in FIG. 9, the second-stage compressor has an orbiting scroll member 220 formed of plate 221 with mirror-imaged involute wraps 222 and 223. The two stationary scroll members 224 and 225 are formed, respectively, of end plate 226 and involute wrap 227 and of end plate 228 and involute wrap 229. These stationary scroll members are bolted to stationary scroll supports 173 and 230 through bolts 175 and 231, and they terminate peripherally in annular walls 232 and 233 which make sealing contact with plate 221 of the orbiting scroll member.

The intermediate-pressure fluid discharged by the first-stage compressor is taken out through discharge conduit 205 to an intercooler 235 constructed in accordance with any suitable design known for heat exchangers made to serve this purpose. From intercooler 235, the cooled fluid at the intermediate pressure is then carried by conduit 236 to inlet port 237 of the second-stage compressor. It will, of course, be understood that a fluid-tight connection is provided between conduit 236 and inlet port 237 through scroll inlet 238 in accordance with known practice. The intermediate-pressure fluid is, during further compression, forced radially inward from peripheral zones 240 and 240', by way of moving pockets 241 and 242 (also 241' and 242') to the central zones of highest pressure 243 and 243'. A series of ports 244 are provided to introduce fluid into and maintain pressure equalized in the corresponding scroll volumes on either side of the orbiting scroll plate 221. High-pressure fluid ports 245 and 246 are cut in plate 221 and end plate 228 to conduit high-pressure fluid to high-pressure discharge means 247 which is connected to a high-pressure discharge line, not shown.

Axial deflections of stationary scroll members 224 and 225 are minimized or eliminated in the same manner as described for the apparatus of FIG. 1 and the first-stage compressor. Thus, the surfaces of scroll supports 230 and 173 facing stationary scroll member end plates 226 and 228 are configured as pistons 250 and 251 operable through sealing rings 252 and 253 in cylinders 254 and 255 to define central, high-pressure fluid volumes 256 and 257 and low-pressure annular fluid volumes 258 and 259 sealed by sealing rings 260 and 261, respectively. Central volumes 256 and 257 are in fluid communication with the central zones of highest pressure 243 and 243' through discharge port 246 and port 262, respectively; and annular volumes 258 and 259 are in fluid communication with the zones of lowest pressure through inlet port 237 and port 263.

As will be seen more clearly in FIGS. 9 and 11, stationary scroll support member 172 associated with stationary scroll 166 of the first-stage compressor and support member 173 associated with stationary scroll 167 of the first-stage compressor and stationary scroll 225 of the second-stage compressor each have three equally-spaced peripheral stationary scroll extensions 270 and 271 which are mounted through journal bearings 272 and 273 to three equally spaced crankshafts 274 having axes of rotation 275. Scroll support member 230 associated with stationary scroll 224 is an integral part of the housing. Two eccentrics 280 and 281 are mounted through bearings 282 and 283 on crankshaft 274, eccentric 280 being associated with the orbiting scroll members of the first-stage compressor and eccentric 281 with the orbiting scroll members of the second-stage compressor. These eccentrics have axes 284 and 285, the distance between these axes and crankshaft axis 275 being the orbit radius of the orbiting scroll members.

Figure 6:
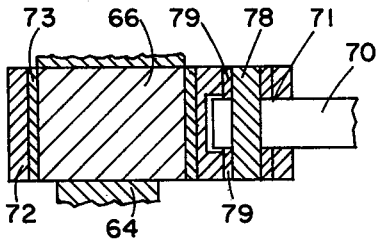
FIG. 6 is cross section of the orbiting scroll linking member.

Plate 163 of the orbiting scroll members of the first-stage compressor has three, equally-spaced peripheral extensions 290 (FIG. 11) each attached through a pin 291 to a swing link 262 attached to eccentric 280 through bearing 282 in the same manner as shown in FIG. 6. Likewise, as shown in FIG. 10 plate 221 of the orbiting scrolls of the second-stage compressor has three equally spaced peripheral extensions 295, each attached through a pin 296 to a swing link 297 attached to eccentric 281 through bearing 283.

As will be seen from FIGS. 9 and 11, the orbiting scroll members of the first and second stages move in opposition to each other, a fact which materially reduces any requirement for counter-balancing of the forces during operation. Each crankshaft 274 terminates in a frustoconically-configured stub shaft 300 keyed to a counterbalancing driven gear 301 (satellite gear). Each driven gear 301 has a series of weight-adjusting holes 302 which permit it to provide the necessary counterbalancing of forces for its associated orbiting scroll driving systems. The three driven gears 301 engage a single central driving gear 303 mounted on main drive shaft 304, attached to motor means not shown, which is supported and aligned through bearing 305 held by scroll support 172 and bearing 306 held by the front housing plate 307. The shaft seal housing plate 309 is bolted to shaft seal housing 310 and sealed through an appropriate sealing ring 308.

The fluid-tight housing comprises, in addition to scroll support 230 and front housing plate 307, a central section 315 of a somewhat triangular cross section (FIG. 11) which terminates in an oil sump 316 containing lubricating oil 317.

It will be apparent that the apparatus of FIG. 9 may also serve as a two-stage expander in which the order of fluid flow is reversed from that described for the compressor of FIGS. 9–11. Thus, the high-pressure fluid to be expanded is initially introduced into the apparatus through inlet 247 and ports 246 and 245 into stage 161 which serves as the first-stage of the expander rather than the second stage of the compressor. From peripheral zones 240 and 240' the fluid at intermediate pressure is taken through conduit 236 to heat exchanger 235 adapted to provide refrigeration to a load before being taken into the central pockets 189' and 189, through line 204, passage 203 and port 202, of the second stage 160 of the expander (the first stage of the apparatus when operating as a compressor). The low-pressure, low-temperature fluid is then conducted by way of line 180 to a reservoir through a second heat exchanger to provide additional refrigeration.

In operating as a two-stage expander it will, of course, be understood that, as in the case of the apparatus of FIG. 1, the driven gears 301 become driving gears and the driving gear 303 becomes the driven gear and main shaft 304 is connected to a work-absorbing means rather than to a motor.

Figure 12:
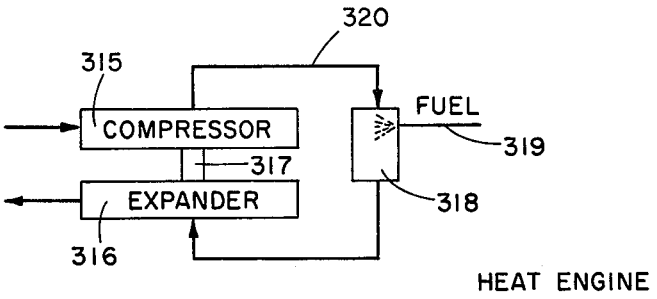
FIG. 12 is a diagrammatic representation of a heat engine constructed to incorporate the scroll apparatus of this invention.
Figure 13:
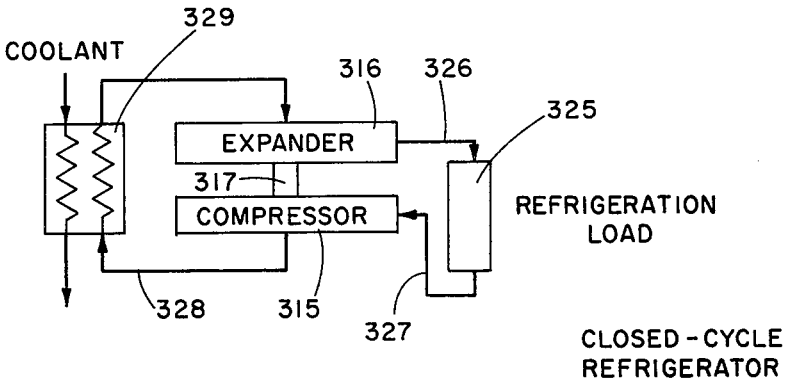
FIG. 13 is a diagrammatic representation of a closed-cycle refrigerator incorporating scroll apparatus of this invention.

FIGS. 12 and 13 are schematics of a heat engine and closed-cycle refrigerator, respectively, incorporating the scroll apparatus (either that of FIGS. 1–8 or FIGS. 9–11) of this invention. In the heat engine of FIG. 12 a compressor 315 (single or multistage) and an expander 316 (single or multistage) are mounted on a common shaft 317 and combustion chamber means 318 with fuel delivery means 319 is interposed in the fluid line 320 joining the compressor discharge and expander inlet. Such combustion chamber and fuel delivery means are well known in the art.

In the closed-cycle refrigerator of FIG. 13 the cold expanded fluid from expander 316 is delivered via line 326 to a refrigeration load 325, and then to the inlet of compressor 315 by line 327; and the recompressed fluid is taken by line 328 through an aftercooler 329 back to expander 316. A suitable coolant may be supplied to effect out-of-contact heat exchange with the compressed fluid.

It will be apparent from the above-detailed description of the peripherally-driven scroll apparatus of this invention that this apparatus minimizes or eliminates the principal disadvantages associated with prior art peripherally driven apparatus of this type. Thus, by attaching the orbiting scroll member to the eccentric shafts through radial compliance means it is possible to accommodate differential thermal expansion in the orbiting scroll member, to locate it uniquely with relation to its associated frame, and to prevent the generation of elastic forces with lead to undue wear and serious leakage problems.

When this compliant linking means is combined with the sealed piston cavities ported to the zones of highest pressure and interposed between the stationary scroll members and their associated support means, axial deflection of the stationary scroll members is essentially eliminated. This in turn minimizes axial leakage and increases the thermal efficiency of the apparatus. This means to eliminate axial deflection also affords flexibility in frame construction. Finally, the combination of the peripheral driving means of this invention with orbiting scroll members having oppositely disposed involute wraps on a common plate makes it possible to provide efficient single and multistage compressors and expanders.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

We claim:

1. A positive fluid displacement apparatus, comprising in combination (a) an orbiting scroll member comprising a plate having mirror-imaged involute wraps affixed to opposite surfaces of said plate and three, equally-spaced peripheral extensions;

(b) first and second oppositely disposed stationary scroll members, each comprising an end plate having an involute wrap affixed thereto engageable with an involute wrap of said orbiting scroll member, whereby when said orbiting scroll member is orbited with respect to said stationary scroll members the flanks of said engaging wraps along with said plate of said orbiting scroll member and the internal facing surfaces of said end plates of said stationary scroll members define mirror-imaged moving pockets of variable volume and zones of high and low fluid pressures;

(c) first and second oppositely disposed stationary scroll support members affixed to said first and second stationary scroll members, respectively, only around their peripheries, each of said support members having three, equally-spaced peripheral projections axially aligned with the peripheral projections of the opposed scroll support member;

(d) three equally spaced crankshafts, each having affixed thereto a satellite gear and each being supported in said axially aligned projections of said opposed scroll support members and rotatable with respect to said stationary scroll members;

(e) an orbiting scroll eccentric affixed to each of said crankshafts and interposed between said peripheral projections;

(f) radially compliant linking means mechanically connecting said orbiting scroll member through said peripheral extension to said eccentrics whereby there is provided a three-link connection around said orbiting scroll member;

(g) fluid passage means in fluid communication with said zones of high and low fluid pressures;

(h) a central gear engageable with said satellite gears and mounted on a rotatable shaft; and (i) energy converting means connected to said rotatable shaft arranged to either drive said shaft or absorb energy from its rotation.

2. A positive fluid displacement apparatus in accordance with claim 1 including fluid ports cut through said plate of said orbiting scroll member arranged to provide fluid communication between said mirror-imaged fluid pockets.

3. A positive fluid displacement apparatus in accordance with claim 1 wherein said first and second stationary scroll members each have a peripheral annular ring engageable with said plate of said orbiting scroll member to define therewith said zones of low fluid pressure.

4. A positive fluid displacement apparatus in accordance with claim 1 wherein said radially compliant linking means comprises for each eccentric a linking member affixed to said eccentric and rotatably attached to said extension of said orbiting scroll member through a pin shaft.

5. A positive fluid displacement apparatus in accordance with claim 1 wherein high-pressure fluid is introduced into said high-pressure fluid zone to drive said orbiting scroll member, said satellite gears drive said central gear to rotate said shaft, said energy converting means comprise work absorbing means and said apparatus is an expander.

6. A positive fluid displacement apparatus in accordance with claim 1 wherein low-pressure fluid is introduced into said low-pressure fluid zone, said energy converting means comprise motor means to rotate said central and satellite gears and drive said orbiting scroll member, and said apparatus is a compressor.

7. A positive fluid displacement apparatus in accordance with claim 1 including counterweight means affixed to said crankshafts arranged to essentially eliminate any unbalanced forces resulting from the orbiting of said orbiting scroll member.

8. A positive fluid displacement apparatus in accordance with claim 7 wherein said satellite gears serve as at least a part of said counterweight means.

9. A positive fluid displacement apparatus in accordance with claim 1 including axial sealing means associated with the contacting end surfaces of said wraps of said orbiting and stationary scroll members.

10. A positive fluid displacement apparatus in accordance with claim 9 wherein said contacting end surfaces of said wraps have a channel cut therein along essentially the entire wrap length and said axial sealing means comprise a seal element sized and configured to be able to experience small axial and radial excursions in said channel, and means to force said seal element into contact with its contacting end plate surface.

11. A positive fluid displacement apparatus in accordance with claim 9 wherein said axial sealing means comprises an abradable coating on said contacting end surfaces of said wraps.

12. A positive fluid displacement apparatus in accordance with claim 1 including housing means defining therein a volume in which said scroll members, said scroll support members, said crankshafts, and said gears are located.

13. A positive fluid displacement apparatus in accordance with claim 12 including oil sump means within said housing.

14. A positive fluid displacement apparatus in accordance with claim 12 including means to provide a fluid force of a predetermined pressure distribution against the external surfaces of said end plates of said stationary scroll members such that the net pressure force across said fixed scroll members is essentially zero.

15. A positive fluid displacement apparatus in accordance with claim 14 wherein the external surface of each of said stationary scroll member end plates defines a central shallow cylinder, and the surface of each of said scroll support members facing its respective stationary scroll member is configured to define (1) a central piston moving within said cylinder to provide a central fluid volume and (2) an annular surface arranged to define an annular fluid volume with said external surface of said end plate; and fluid port means to provide fluid communication between said central fluid volumes and said zone of high pressure and between said annular fluid volumes and said zone of low pressure.

16. A multistage positive fluid displacement apparatus, comprising in combination (a) at least two scroll means, each of which serves as a stage and comprises in combination (1) an orbiting scroll member comprising a plate having mirror-imaged involute wraps affixed to opposite surfaces of said plate and three, equally-spaced peripheral extensions;

(2) first and second oppositely disposed stationary scroll members, each comprising an end plate having an involute wrap affixed thereto engageable with an involute wrap of said orbiting scroll member, whereby when said orbiting scroll member is orbited with respect to said stationary scroll members the flanks of said engaging wraps along with said plate of said orbiting scroll member and the internal facing surfaces of said end plates of said stationary scroll members define mirror-imaged moving pockets of variable volume and zones of high and low fluid pressures;

(3) first and second oppositely disposed stationary scroll support members affixed to said first and second stationary scroll members, respectively, only around their peripheries, each of said support members having three, equally-spaced peripheral projections axially aligned with the peripheral projections of the opposed scroll support member;

(b) three equally spaced crankshafts, each having affixed thereto a satellite gear and each being supported in said axially aligned projections of said opposed scroll support members and rotatable with respect to said stationary scroll members of said scroll means;

(c) orbiting scroll eccentrics, one for each of said orbiting scroll members, affixed to each of said crankshafts;

(d) radially compliant linking means mechanically connecting said orbiting scroll members through said peripheral extensions to said eccentrics whereby there is provided a three-link connection around each of said orbiting scroll members;

(e) a central gear engageable with said satellite gears and mounted on a rotatable shaft;

(f) housing means defining therein a volume in which said scroll means, said crankshafts and said gears are located;

(g) fluid passage means in fluid communication with said zones of high and low fluid pressures of said scroll means; and (h) energy converting means connected to said rotatable shaft arranged to either drive said shaft or absorb energy from its rotation.

17. A multistage positive fluid displacement apparatus in accordance with claim 16 including fluid ports cut through said plates of said orbiting scroll members arranged to provide fluid communication between mirror-imaged fluid pockets.

18. A multistage positive fluid displacement apparatus in accordance with claim 16 wherein said satellite gears are counter-weighted to essentially eliminate any unbalanced forces resulting from the orbiting scroll members.

19. A positive fluid displacement apparatus in accordance with claim 16 wherein said first and second stationary scroll members each have a peripheral annular ring engageable with said plate of said orbiting scroll member to define therewith said zones of low fluid pressure.

20. A multistage positive fluid displacement apparatus in accordance with claim 16 wherein said radially compliant linking means comprises for each eccentric a linking member affixed to said eccentric and rotatably attached to said extension of said orbiting scroll member through a pin shaft.

21. A multistage positive fluid displacement apparatus in accordance with claim 16 wherein said eccentrics are so affixed to said crankshafts relative to each other as to cause said orbiting scroll members of said scroll means to be at least in part self-balancing.

22. A multistage positive fluid displacement apparatus in accordance with claim 16 wherein one of said stationary scroll support members for one of said scroll means serves as one of said stationary scroll support members for an adjacent scroll means.

23. A multistage positive fluid displacement apparatus in accordance with claim 16 wherein said housing means serves as one of said stationary scroll support members for one of said scroll means.

24. A multistage fluid displacement apparatus in accordance with claim 16 including axial sealing means associated with the contacting end surfaces of said wraps of said orbiting and stationary scroll members.

25. A multistage positive fluid displacement apparatus in accordance with claim 24 wherein said contacting end surfaces of said wraps have a channel cut therein along essentially the entire wrap lenth and said axial sealing means comrpise a seal element sized and configured to be able to experience small axial and radial excursions in said channel, and means to force said seal element into contact with its contacting end plate surface.

26. A multistage positive fluid displacement apparatus in accordance with claim 24 wherein said axial sealing means comprises an abradable coating on said contacting end surfaces of said wraps.

27. A positive fluid displacement apparatus in accordance with claim 16 including means to provide a fluid force of a predetermined pressure distribution against the external surfaces of said end plates of said stationary scroll members such that the net pressure force across said fixed scroll members in each scroll means is essentially zero.

28. A multistage positive fluid displacement apparatus in accordance with claim 27 wherein the external surface of each of said stationary scroll member end plates of each of said scroll means defines a central shallow cylinder, and the surface of each of said scroll support members of each of said scroll means facing its respective stationary scroll member is configured to define (1) a central piston moving within said cylinder to provide a central fluid volume, and (2) an annular surface arranged to define an annular fluid volume with said external surface of said end plate; and fluid port means to provide fluid communication between said central fluid volumes and said zone of high pressure of said scroll means and between said annular fluid volume and said zone of low pressure of said scroll means.

29. A multistage positive fluid displacement apparatus in accordance with claim 16 wherein the total volume of said fluid pockets and zones of high and low pressure in a scroll means is a function of the average pressure in said scroll means and is controlled by the height of the wraps of the orbiting and stationary scroll members of said scroll means.

30. A multistage positive fluid displacement apparatus in accordance with claim 29 wherein said fluid passage means includes fluid conduit means between said high-pressure fluid zone of one of said scroll means and said low-pressure fluid zone of an adjacent scroll means.

31. A multistage positive fluid displacement apparatus in accordance with claim 30 including heat exchange means associated with said fluid conduit means.

32. A multistage positive fluid displacement apparatus in accordance with claim 31 wherein high-pressure fluid is introduced into the first stage, said heat exchange means provides means to deliver refrigeration to a load, said energy converting means comprise work absorbing means and said apparatus is a multistage expander.

33. A multistage positive fluid displacement apparatus in accordance with claim 31 wherein low-pressure fluid is introduced into the first stage, said heat exchange means is an intercooler means, said energy converting means comprise a motor and said apparatus is a multistage expander.

34. A multistage positive fluid displacement apparatus in accordance with claim 33 wherein said housing is fluid-tight and said volume defined therein provides said fluid passage means in communication with said zone of low fluid pressure for said first stage.

* * * * *